US005158317A

United States Patent [19]

Sedlmair et al.

[11] Patent Number: 5,158,317

[45] Date of Patent: * Oct. 27, 1992

[54] SKI BRAKE ASSEMBLY

[75] Inventors: Gerhard Sedlmair, Farchant; Heinz Hoernschemeyer, Oberammergau, both of Fed. Rep. of Germany

[73] Assignee: Marker Deutschland GmbH, Fed. Rep. of Germany

[ * ] Notice: The portion of the term of this patent subsequent to Jul. 23, 2008 has been disclaimed.

[21] Appl. No.: 677,794

[22] Filed: Mar. 29, 1991

Related U.S. Application Data

[63] Continuation of Ser. No. 431,045, Nov. 2, 1989, Pat. No. 5,033,766.

[30] Foreign Application Priority Data

Nov. 3, 1988 [DE] Fed. Rep. of Germany ..... 3837379

[51] Int. Cl.[5] ..... A63C 7/10

[52] U.S. Cl. ..... 280/605

[58] Field of Search ..... 280/604, 605, 620, 636, 280/809; 188/5, 6, 8

[56] References Cited

U.S. PATENT DOCUMENTS

| | | | |
|---|---|---|---|
| Re. 32,567 | 12/1987 | Emert et al. | 280/605 |
| 4,173,354 | 11/1979 | Murata | 280/605 |
| 4,379,570 | 4/1983 | Sedlmair | 280/605 |
| 4,463,967 | 8/1984 | Klubitschko | 280/605 |
| 4,470,614 | 9/1984 | Sedlmair | 280/605 |
| 4,485,536 | 12/1984 | Klubitschko | 280/605 |
| 4,515,388 | 5/1985 | Emert et al. | 280/605 |
| 4,537,418 | 8/1985 | Knabel et al. | 280/605 |
| 4,564,211 | 1/1986 | Luitz et al. | 280/605 |
| 4,687,221 | 8/1987 | Salomon | 280/605 |
| 4,763,918 | 8/1988 | Sedlmair | 280/605 |
| 4,878,687 | 11/1989 | Stritzl et al. | 280/605 |
| 4,973,072 | 11/1990 | Stritzl et al. | 280/605 |
| 5,033,766 | 7/1991 | Sedlmair et al. | 280/605 |

FOREIGN PATENT DOCUMENTS

| | | | |
|---|---|---|---|
| 61590 | 10/1982 | European Pat. Off. | 280/605 |
| 227939 | 7/1987 | European Pat. Off. | 280/605 |
| 2632849 | 1/1978 | Fed. Rep. of Germany | 280/605 |

*Primary Examiner*—David M. Mitchell
*Assistant Examiner*—Brian L. Johnson
*Attorney, Agent, or Firm*—D. Peter Hochberg; Mark Kusner; Louis J. Weisz

[57] ABSTRACT

A ski brake assembly mountable on a ski for impeding movement of the ski down a slope when the ski is detached from a skier's boot, the ski having a longitudinal axis, a top surface and a bottom surface. A pedal is operably attached to a pivot shaft, and is movable between a skiing position wherein the ski brake is in the non-braking position and a release position wherein the braking arm is in the braking position. The pedal and pivot shaft are operable to rotate the braking arm toward the axis of the ski as the pedal is moved toward the skiing position by the engagement of surfaces on the pedal and the pivot shaft, to rotate the pivot shaft about part of the pedal.

13 Claims, 3 Drawing Sheets

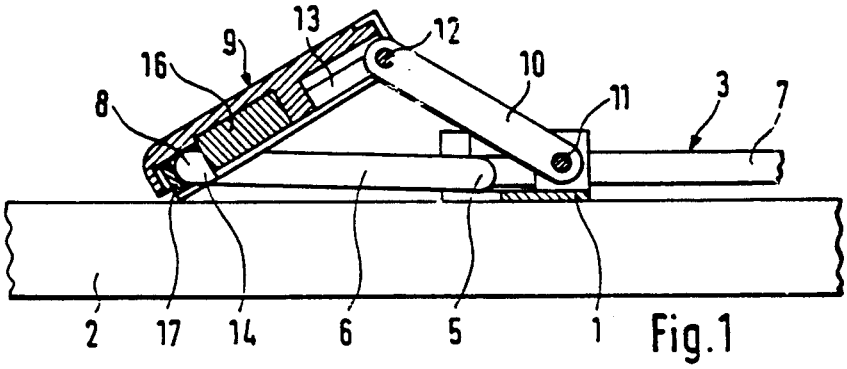
Fig.1
Fig.2
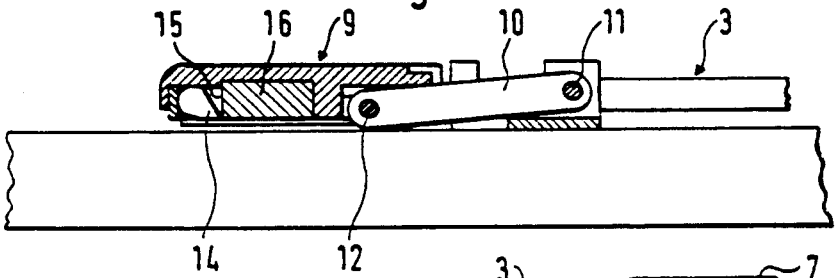
FiG. 3
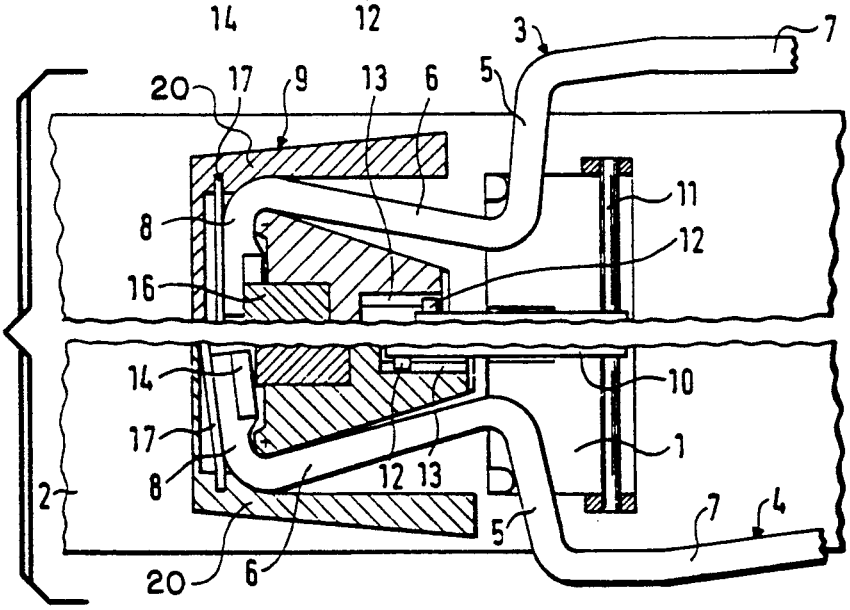

SKI BRAKE ASSEMBLY

Ser. No. 07/431,045, filed on Nov. 2, 1989, of which the present application is a continuation application, is now U.S. Pat. No. 5,033,766.

FIELD OF THE INVENTION

The present invention relates to ski brakes, and more particularly to ski brakes which are actuated when a ski boot releases pressure on a pedal.

Background of the Invention

The present invention generally relates to a ski braking mechanism wherein the braking unit includes a pair of movable levers, each having a pivot shaft intermediate a lower arm and an upper arm. The levers are generally rotatable about the pivot shaft between a braking position in which the lower arm extends below the bottom surface of the ski and a non-braking position wherein the levers are generally parallel with the upper surface of the ski. The upper arm is generally connected to a brake pedal which is dimensioned to engage with the bottom of a ski boot. The pedal is connected to an actuator arm which is operative to bias the pedal to a release position when pressure from the ski boot is removed. The brake pedal and the actuator arm form a toggle joint wherein the pedal is movable between a skiing position wherein the levers are in the non-braking position parallel to the surface of the ski and the release position wherein the lever arms are in a braking position.

In some known ski brakes, the lower arms of the braking levers turn or pivot inwardly toward the axis of the ski when the levers are in a non-braking position. This movement typically occurs when the toggle joint is depressed and the brake arms are parallel to the ski, and is effected by providing operating surfaces on the under side of the pedal to influence the upper arm portion of the lever in a certain direction and thus move the lower arms toward the longitudinal axis of the ski. One essential advantage of such a ski brake is that the pedal performs only pivotal movement as the toggle joint is depressed and that the pedal does not move in a longitudinal direction relative to the top surface of the ski. As a result, any frictional resistance particularly between the pedal and the ski boot of the skier is minimized.

Summary of the Invention

It is an object that the present invention to provide a ski brake assembly of the type described above including the specific advantages of such brakes and further including a pedal arrangement which is simple, can be manufactured at a lower cost, and is more reliable than ski brakes known heretofore.

In accordance with the present invention, there is provided a ski brake assembly which is mountable on a ski for impeding movement of the ski down a slope when the ski is detached from a skier's boot, the ski having a longitudinal axis, a top surface and a bottom surface. The ski brake includes a braking arm, a first pivot shaft about which the braking arm is rotatable to move between a braking position in which it extends below the bottom surface of the ski and a non-braking position in which it does not extend below the ski. A retaining arm extends from the first pivot shaft to a second pivot shaft which is generally perpendicular to the axis of the ski. Pedal means are provided for operable attachment to the second pivot shaft. The pedal means are movable between a skiing position wherein the braking arm is in the nonbraking position and a release position wherein the braking arm is in the braking position. First biasing means are provided for biasing the pedal means to the release position. Means for pivoting the ski brake are provided to rotate the braking arm inboard or toward the longitudinal axis of the ski when the pedal means is in the skiing position. The means for pivoting the braking arm inboard includes surfaces on the pedal means and on the second pivot shaft operative to pivot the ski brake about a predetermined axis relative to the pedal.

DRAWINGS

The invention may take physical form in certain parts and arrangement of parts, preferred embodiments of which were described in detail in the specification and illustrated in the accompanying drawings wherein:

FIG. 2 is a sectional elevational view of a ski brake illustrated in FIG. 1 showing the ski brake in its retracted position;

FIG. 3 is a sectional plane view showing the brake illustrated in FIGS. 1 and 2 wherein the upper half of FIG. 3 shows a ski brake in the condition shown in FIG. 1 and the lower half of FIG. 3 shows a ski brake in the condition shown in FIG. 2;

Figure 1A:
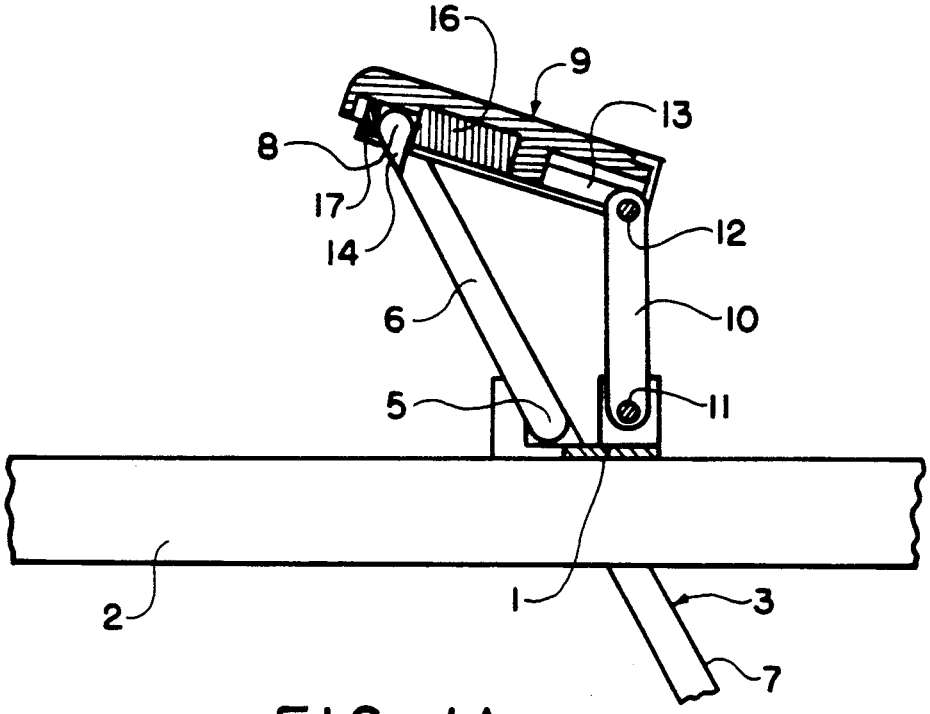
FIG. 1 is a sectional elevational view of a ski brake illustrating a preferred embodiment of the present invention showing the ski brake partially depressed.
Figure 4A:
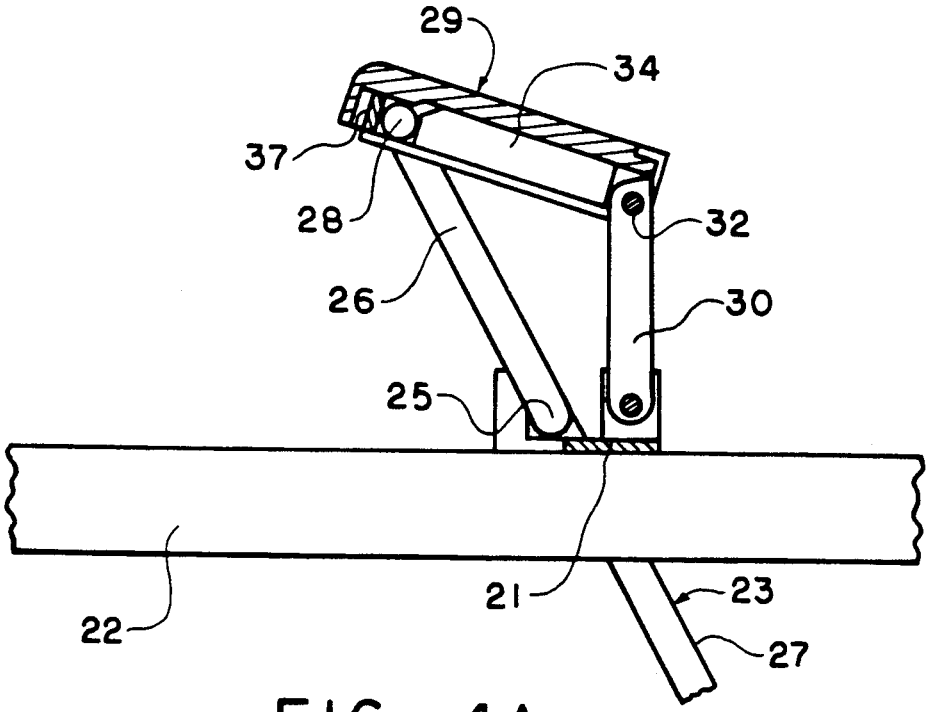
FIGS. 4–6 are views corresponding to FIGS. 1–3 showing a ski brake illustrating a second embodiment of the present invention.
Figure 4:
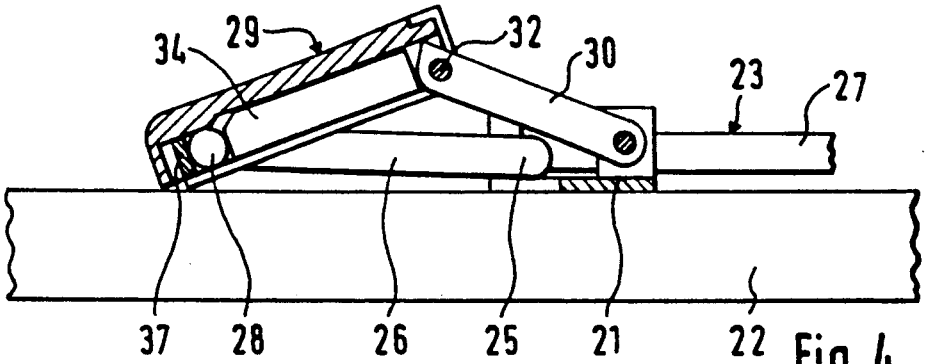

FIGS. 1A and 4A, corresponding to FIGS. 1 and 4 respectively, show the ski brakes illustrated in the embodiments shown in the latter Figures in their braking position.

DETAILED DESCRIPTION OF PREFERRED EMBODIMENTS

Referring now to the drawings wherein the purpose is for illustrating preferred embodiments of the present invention only and not for the purpose of limiting same, FIGS. 1–3 show a brake assembly of a ski binding including a base plate 1 which is adapted to be screw connected to a ski 2. In a manner as is conventionally known, the base plate may be extended in length and may carry other parts of the safety ski binding. In the case of the latter, the base plate is preferably not connected directly to the ski, but rather is attached to a guide plate which is slidable in a longitudinal direction of a ski. The brake assembly has two ski brakes 3, 4 which are provided on both sides of ski 2 and which are generally comprised of pieces of wire having a circular cross-section. Ski brakes 3 and 4 each include a cross piece or first pivot shaft 5 which is movably mounted on the base plate. Pivot shaft 5 is perpendicular to ski brake 3, 4 and extends generally perpendicular to the longitudinal axis of the ski when the brake assembly is fully raised in its braking condition. First pivot shaft portions 5 are generally co-axial to each other. Ski brakes 3 and 4 include upper portions ("upper" and "lower" refer to the ski brakes when the binding is on the ground and the ski brake is in its braking condition), shown on the left side of the drawings, which constitute retaining arms 6 which join second pivot shaft 8. The lower portions (shown on the right side of the drawings), of the levers constitute the braking arms 7. As best seen in FIG. 3, the free ends of the second pivot shafts 8 are angled toward each other, and engage and help support a pedal 9 which is operable by a ski boot (not shown). When a force is applied to second pivot shaft 8 as described below, brake arms 3, 4 pivot about the juncture of retaining arm 6 and second pivot shaft 8 which is contained within the pedal 9, and part 20 of the pedal which the juncture engages, to rotate the brake arm 7 inboard or outboard of the ski.

Pedal 9 comprises one arm of a toggle joint. An actuator member or arm 10 comprises the second arm of the toggle joint and is rotatably mounted on base plate 1 by means of a pivot pin 11 which is spaced from the turning shaft portions. The hinge of the toggle joint is comprised of a pivot pin 12 which is pivotally and slidably mounted in pedal 9. In this respect, the free ends of pivot pin 12 are received into guides or grooves 13 in pedal 9. The actuator arm 10 of the toggle joint is biased by a spring (not shown) which urges the actuator arm 10 in a clockwise direction as seen in the drawings to bias the ski brake into a release or braking position. In a conventional manner, the spring which biases actuator arm 10 may be comprised of a coil spring that is subjected to bending and may movably be mounted on pivot pin 11.

Each of second pivot shafts 8 are provided with a cam-like enlarged portion 14 (see FIG. 2). The cam-like portion 14 is dimensioned to cooperate with a surface 15 of a pressure applying member 16 which is part of pedal 9. Since the pressure applying member comes into forcible engagement with the metal surface of the wire ski brakes, it is preferable that the member be formed from material hard enough to withstand such engagement, for example, metal (as shown in graphic symbol in FIGS. 1-3). In the embodiment shown, surface 15 is disposed approximately at right angles to the tread surface of pedal 9 and generally parallel to the pivotal axis of pedal 9. Cam portion 14 is biased into engagement with surface 15 by a leaf spring 17 which is supported in pedal 9 at both ends.

Referring now to the operation of the ski brake shown in FIGS. 1-3, FIG. 1 shows the ski brakes in a transitional position which is assumed as a ski boot (not shown) is inserted into a safety ski binding (not shown). The ski brake is shown after it has moved out of its braking position in a counter-clockwise direction against for example, a coil spring biasing force which biases in a clockwise direction the actuator arm 10 of the toggle joint. As pedal 9 is further depressed, it assumes the stand-by position shown in FIG. 2, wherein ski brakes 3, 4 are turned inwardly toward the axis of the ski as shown in the lower half of FIG. 3. Such rotation of brake arm 7 inboard or in-turning of the brake arms is effected by the action of the pressure applying member 16, which with its operable surface 15, engages the enlarged cam portion 14 of retaining arm 6. As pedal 9 is pressed towards the ski, its surface engages the cam portion 14 and rotates the ski brake about part 20 of the pedal at the juncture of second pivot shaft 8 and retaining arm 6 to rotate the brake arm 7 inboard. The rotation of the ski brake causes the second pivot shaft to rotate against leaf spring 17. If the load of a ski boot is removed from the pedal, the leaf spring 17 will engage the pivot shaft 8 to rotate ski brake 3, 4 the other way to spread the brake arms 7 as pedal 9 rises under the influence of actuator arm 10.

Figure 5:
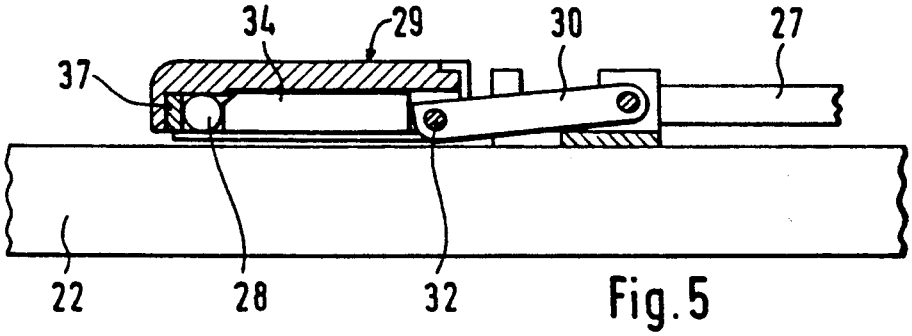
Figure 6:
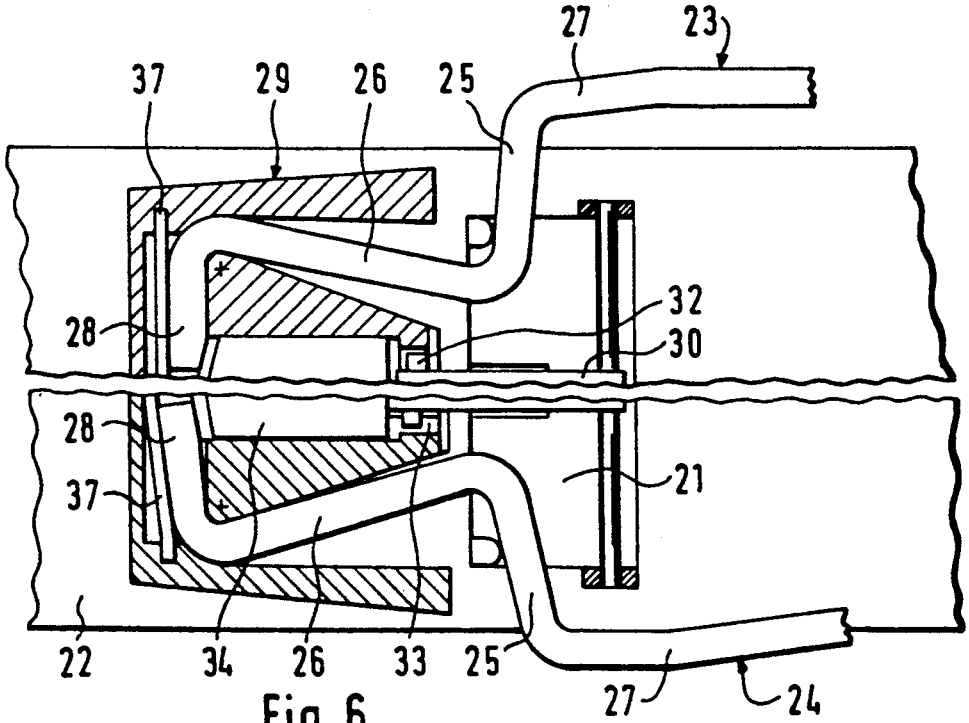

The ski brake shown in FIGS. 4-6 has basically the same design as that shown in FIGS. 1, 2, and 3. A brake assembly of a ski binding includes a base plate 21 by which ski brakes 23, 24 are attached to a ski 22. Each of the ski brakes 23, 24 has a cross piece or first pivot shaft 25, a retaining arm 26, and a brake arm 27. The retaining arm 26 is joined to second pivot shaft 28 which is connected to a pedal 29. Together with an actuating arm 30, pedal 29 comprises a toggle joint which has a hinge that is comprised of a pivot pin 32. Pin 32 has free ends which extend into longitudinal guide grooves 33 in pedal 29. As in the embodiment shown in FIGS. 1-3, actuating arm 30 is biased by a spring for example, a coil spring (not shown) to a release position. A difference from the first embodiment resides in that the part for engaging the pivot shaft is comprised of a sliding element 34 which is mounted on pedal 29 to be movable at least approximately parallel to the tread surface of the pedal. Element 34 is adapted to be influenced by actuating arm 30 and includes a surface operative to engage the second pivot shaft 28 of the ski brake. Sliding element 34 acts on the free ends of the second pivot shaft 28 which is biased by leaf spring 37. Leaf spring 37 is supported in pedal 29 at both ends. During the movement from the partially depressed position shown in FIG. 4 to the retracted position shown in FIG. 5, pivot pin 32 is displaced in the guide or grooves 33 of pedal 29. As a result, the inner end of arm 30 applies pressure to the sliding element 34 such that the latter is displaced in the pedal 29. Slide element 34 engages the free ends of second pivot shaft 28 which causes the ski brake 23 24 to pivot inwardly as shown in FIG. 6, lower half. As pedal 29 is pressed towards the ski, sliding element 34 on the pedal applies force to the second pivot shaft 28, and rotates the ski brake about part 40 of the pedal where it is engaged by the juncture of retaining arm 26 and second pivot shaft 28. The second pivot shaft is moved against the leaf spring 37 as the pivoting occurs. The separation of the brake levers is again effected by the leaf spring 37 as a brake is lowered after the load on pedal has been relieved.

Various modifications of the design may be adopted within the scope of the present invention. For instance, sliding element 34 may be replaced by a link which connects the free end of the second pivot shaft 28 to pivot pin 32 in which case, leaf spring 37 may be omitted. These and other modifications and alterations will occur to others upon their reading and understanding of this specification. It is intended that all such modifications and alterations be included insofar as they come within the scope of the invention as claimed or the equivalents thereof.

Having described the invention, the following is claimed:

1. A ski brake assembly mountable on a ski for impeding movement of the ski down a slope when the ski is detached from a skier's boot, the ski having a longitudinal axis, a top surface and a bottom surface, said ski brake assembly comprising:

a ski brake comprising a first pivot shaft generally transverse to the longitudinal axis, a generally longitudinal braking arm, a generally longitudinal retaining arm, said arms being connected to opposite end portions of said first pivot shaft, and a second pivot shaft joined to said retaining arm at a juncture, said brake being rotatable about said first pivot shaft between a braking position in which said braking arm extends below said bottom surface of said ski and a non-braking position in which said braking arm is positioned above the bottom surface of said ski, said second pivot shaft extending generally transverse to the longitudinal axis of said ski, pedal means operably attached to said second pivot shaft and including an integral pressure member, said pedal means movable between a skiing position wherein said braking arm is in said non-braking position and a release position wherein said braking arm is in said braking position, said juncture being fully contained within the pedal means, and pivoting means for pivoting said ski brake to rotate said braking arm toward said longitudinal axis of said ski when said pedal means is in said skiing position, said pivoting means including surfaces on said second pivot shaft, and surfaces on said pressure member of said pedal means for operatively engaging said surfaces on said second pivot shaft as said pedal means is moved to the skiing position, said movement of said pedal means to the skiing position rotating the juncture of said second pivot shaft and said retaining arm within said pedal means to move said braking arm inboard toward the longitudinal axis.

2. A ski brake assembly as defined in claim 1 wherein said ski brake assembly has base means, connecting means, and an actuating arm operatively connected to said pedal means by said connecting means and to said base means, said actuating arm urging said surfaces of said pressure member of said pedal means against said surfaces of said second pivot shaft when said pedal means is moved to the skiing position.

3. A ski brake assembly as defined in claim 2 and further comprising a pin on said actuating arm and a slot extending logitudinally in said pedal means, said pedal means and said actuating arm forming a toggle joint for urging said pedal means against said second pivot shaft as said pedal means moves to a skiing position to move said surfaces on said pressure member against the surfaces on said second pivot shaft.

4. A ski brake assembly as defined in claim 1 wherein a surface on said second pivot shaft is generally wedge-shaped and a surface on said pedal means is generally at a right angle to said surface of said second pivot shaft.

5. A ski brake assembly according to claim 1 and further including biasing means for biasing said surfaces of said pedal means pressure member and said surfaces of second pivot shaft together into operative engagement.

6. A ski brake assembly as defined in claim 5 wherein said biasing means is a leaf spring mounted in said pedal means.

7. A ski brake assembly mountable on a ski for impeding movement of the ski down a slope when the ski is detached from a skier's boot, the ski having a longitudinal axis, a top surface and a bottom surface, said ski brake assembly comprising:

a ski brake comprising a first pivot shaft generally transverse to the longitudinal axis, a generally longitudinal braking arm and a generally longitudinal retaining arm connected to opposite end portions of said first pivot shaft, and a second pivot shaft joined to said retaining arm at a juncture, said ski brake being rotatable about said first pivot shaft between a braking position in which said braking arm extends below said bottom surface of said ski and a non-braking position in which said braking arm is positioned above the bottom surface of said ski, said second pivot shaft extending generally transverse to the longitudinal axis of said ski, pedal means operably attached to said second pivot shaft, said pedal means movable between a skiing position wherein said braking arm is in said non-braking position and a release position wherein said braking arm is in said braking position, said juncture being fully contained within said pedal means, and pivoting means for pivoting said ski brake to rotate said braking arm toward said longitudinal axis of said ski when said pedal means is in said skiing position, said pivoting means including surfaces on said second pivot shaft and on slide means in said pedal means for engaging said surfaces on said second pivot shaft as said pedal means is moved to the skiing position, said movement of said pedal means to the skiing position rotating the juncture of said second pivot shaft and said retaining arm within said pedal means to move said braking arm inboard toward the longitudinal axis.

8. A ski brake assembly as defined in claim 7 wherein said ski brake assembly has base means and connecting means, an actuating arm operatively connected at one end by said connecting means to said pedal means and at the other end to said base means, said actuating arm causing said braking arm to assume said release position.

9. A ski brake assembly as defined in claim 8 wherein said connecting means comprises a pin on said actuating arm and a slot extending longitudinally in said pedal means, said pedal means and said actuating arm forming a toggle joint for urging said pedal means against said second pivot shaft as said pedal means moves toward said skiing position.

10. A ski brake assembly as defined in claim 8 wherein said slide means is longitudinally movable by said actuating arm into operative engagement with said second pivot shaft as said pedal means moves toward said skiing position.

11. A ski brake assembly as defined in claim 7 wherein said second pivot shaft is generally at a right angle to said slide means.

12. A ski brake assembly according to claim 7 and further including biasing means for biasing said slide means and said second pivot shaft together into operative engagement.

13. A ski brake assembly as defined in claim 12 wherein said biasing means is a leaf spring mounted in said pedal means.

* * * * *